US007001154B2

(12) United States Patent
Kim

(10) Patent No.: US 7,001,154 B2
(45) Date of Patent: Feb. 21, 2006

(54) APPARATUS FOR CONTROLLING A LINEAR COMPRESSOR AND PREVENTING THE COLLISION OF A PISTON WITH A VALVE IN THE COMPRESSOR

(75) Inventor: Tae-Duk Kim, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 72 days.

(21) Appl. No.: 09/993,496

(22) Filed: Nov. 27, 2001

(65) Prior Publication Data

US 2003/0044286 A1 Mar. 6, 2003

(30) Foreign Application Priority Data

Sep. 3, 2001 (KR) ..... 2001-53875

(51) Int. Cl.
*F04B 49/12* (2006.01)

(52) U.S. Cl. ..... 417/212; 417/44.1; 417/417; 318/128; 318/129; 310/15; 310/17

(58) Field of Classification Search ..... 417/44.1, 417/212, 416, 417; 318/127, 128, 129; 310/15, 310/17

See application file for complete search history.

(56) References Cited

U.S. PATENT DOCUMENTS

| | | | | |
|---|---|---|---|---|
| 4,772,828 | A * | 9/1988 | Heymans et al. | 318/128 |
| 5,342,176 | A * | 8/1994 | Redlich | 417/212 |
| 5,496,153 | A * | 3/1996 | Redlich | 417/212 |
| 5,897,296 | A * | 4/1999 | Yamamoto et al. | 417/44.1 |
| 5,980,211 | A * | 11/1999 | Tojo et al. | 417/45 |
| 6,074,172 | A * | 6/2000 | Huang | 417/214 |
| 6,089,836 | A | 7/2000 | Seo | 417/417 |
| 6,176,683 | B1 * | 1/2001 | Yang | 417/44.1 |
| 6,663,348 | B1 * | 12/2003 | Schwarz et al. | 417/12 |
| 2002/0064461 | A1 * | 5/2002 | Yoo et al. | 417/44.1 |
| 2003/0129063 | A1 * | 7/2003 | Jeun | 417/45 |

* cited by examiner

*Primary Examiner*—Timothy S. Thorpe
*Assistant Examiner*—Emmanuel Sayoc
(74) *Attorney, Agent, or Firm*—Staas & Halsey LLP

(57) ABSTRACT

Disclosed herein is an apparatus and method for controlling a linear compressor. The linear compressor control apparatus has a collision detection unit, a control unit, and a compressor driving unit. The collision detection unit detects a collision of a piston with a valve due to the operations of the linear compressor. The control unit determines whether the collision of the piston occurs on the basis of an output signal from the collision detection unit, and resets maximum amplitude data of the piston of the linear compressor when the collision occurs. The compressor driving unit controls the maximum amplitude of the piston of the linear compressor under the control of the control unit.

4 Claims, 5 Drawing Sheets

APPARATUS FOR CONTROLLING A LINEAR COMPRESSOR AND PREVENTING THE COLLISION OF A PISTON WITH A VALVE IN THE COMPRESSOR

BACKGROUND OF THE INVENTION

1. Field of the Invention

The present invention relates generally to linear compressors, and more particularly to an apparatus and method for controlling a linear compressor, which prevents the collision of a piston with a valve to improve operational efficiency of the linear compressor during operation of the linear compressor.

2. Description of the Prior Art

FIG. 1 is block diagram of a conventional linear compressor control apparatus.

Referring to FIG. 1, the conventional linear compressor control apparatus comprises a core 10, first and second coils 12 and 13, and a signal processing unit 20. The core 10 of a magnetic substance operates in conjunction with a machine for detecting a position of a piston. The first and second coils 12 and 13 are symmetrically wound around the outside of the core 10. The signal processing unit 20 detects and outputs the change of the core position according to voltages induced in the first and second coils 12 and 13.

The signal processing unit 20 comprises a first full-wave rectifying unit 21, a second full-wave rectifying unit 22, a differential amplifying unit 23, a filter unit 24 and a peak detection unit 25. The first full-wave rectifying unit 21 full-wave rectifies the voltage induced in the first coil 12, and the second full-wave rectifying unit 22 full-wave rectifies the voltage induced in the second coil 13. The differential amplifying unit 23 amplifies the voltage difference between the rectified voltages of the first and second full-wave rectifying units 21 and 22. The filter unit 24 removes high frequency component of an output signal from the differential amplifying unit 23. The peak detection unit 25 detects the maximum value and the minimum value of an output signal from the filter unit 24, and transmits the detected values to a control unit.

The operation of the conventional apparatus having the above construction is described.

When an AC power voltage of several KHz is applied to both the first and second coils 12 and 13 from the outside, if the position of the core 10 is changed due to the change of position of the machine for detecting the position of the piston, voltages proportional to the change in position of the core 10 are induced in the first and second coils 12 and 13. The voltages induced in the first and second coils 12 and 13 are full-wave rectified by the first and second full-wave rectifying units 21 and 22, respectively, and the rectified results are applied to input terminals of the differential amplifying unit 23.

The differential amplifying unit 23 amplifies the voltage difference between the full-wave rectified voltages of the first and second full-wave rectifying units 21 and 22, and outputs the amplified results to the filter unit 24. Then, the filter unit 24 removes the high frequency component of the output signal from the differential amplifying unit 23, amplifies the resulting signal, and outputs the amplified signal to the peak detection unit 25. The peak detection unit 25 full-wave rectifies the output signal from the filter unit 24 and outputs the rectified signal to the microcontroller 30.

The microcontroller 30 controls the stroke of the linear compressor in response to the output signal from the peak detection unit 30, which is obtained by full-wave rectifying the output signal from the filter unit 24.

The conventional linear compressor control apparatus has a constant stroke by controlling only the stroke of the piston of the linear compressor according to the above construction. However, the conventional linear compressor control apparatus is disadvantageous in that it cannot maintain a constant top clearance with respect to the position of its top dead center due to a characteristic of the linear compressor that the center position of the piston is changed according to a load.

SUMMARY OF THE INVENTION

Accordingly, the present invention has been made keeping in mind the above problems occurring in the prior art, and an object of the present invention is to provide an apparatus and method for controlling a linear compressor, which prevents the collision of a piston of the linear compressor with a valve to improve operational efficiency of the linear compressor by controlling a top clearance with respect to the top dead center of the piston.

In accordance with one aspect of the present invention, the above and other objects can be accomplished by the provision an apparatus for controlling a linear compressor, comprising a collision detection unit for detecting a collision of a piston with a valve due to the operations of the linear compressor; a control unit for determining whether the collision of the piston occurs on the basis of an output signal from the collision detection unit, and resetting maximum amplitude data of the piston of the linear compressor when the collision occurs; and a compressor driving unit for controlling the maximum amplitude of the piston of the linear compressor under the control of the control unit.

In accordance with another aspect of the present invention, there is provided a method for controlling a linear compressor, comprising the steps of a) presetting a maximum amplitude of a piston of the linear compressor; b) detecting a signal when the linear compressor operates; c) determining whether any collision of the piston has occurred on the basis of the detected signal; d) resetting the maximum amplitude if it is determined that a collision of the piston has occurred at step c); and e) driving the linear compressor according to the reset maximum amplitude.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
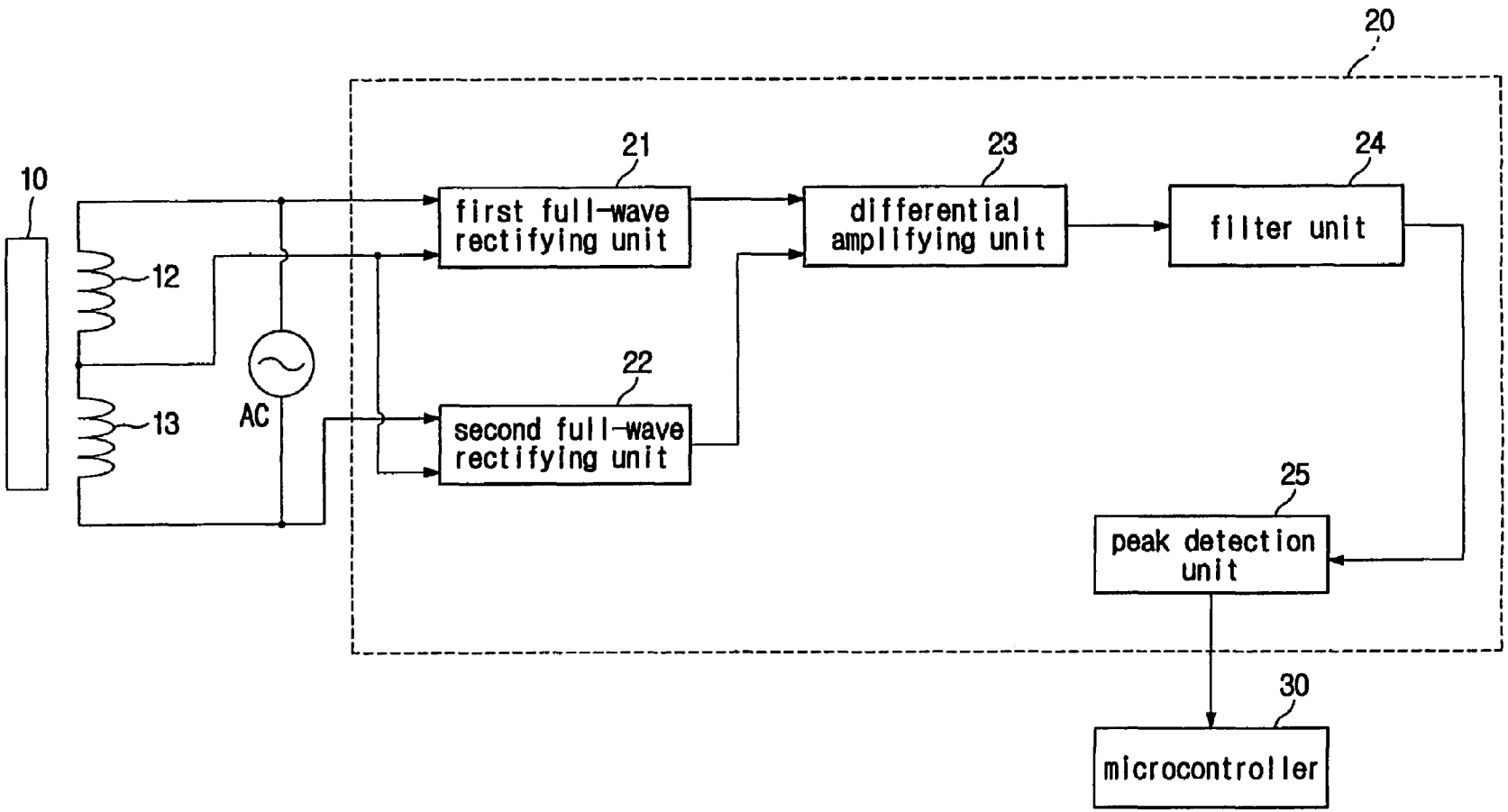
FIG. 1 (Prior Art)
FIG. 1 is a block diagram of a conventional linear compressor control apparatus.
Figure 2:
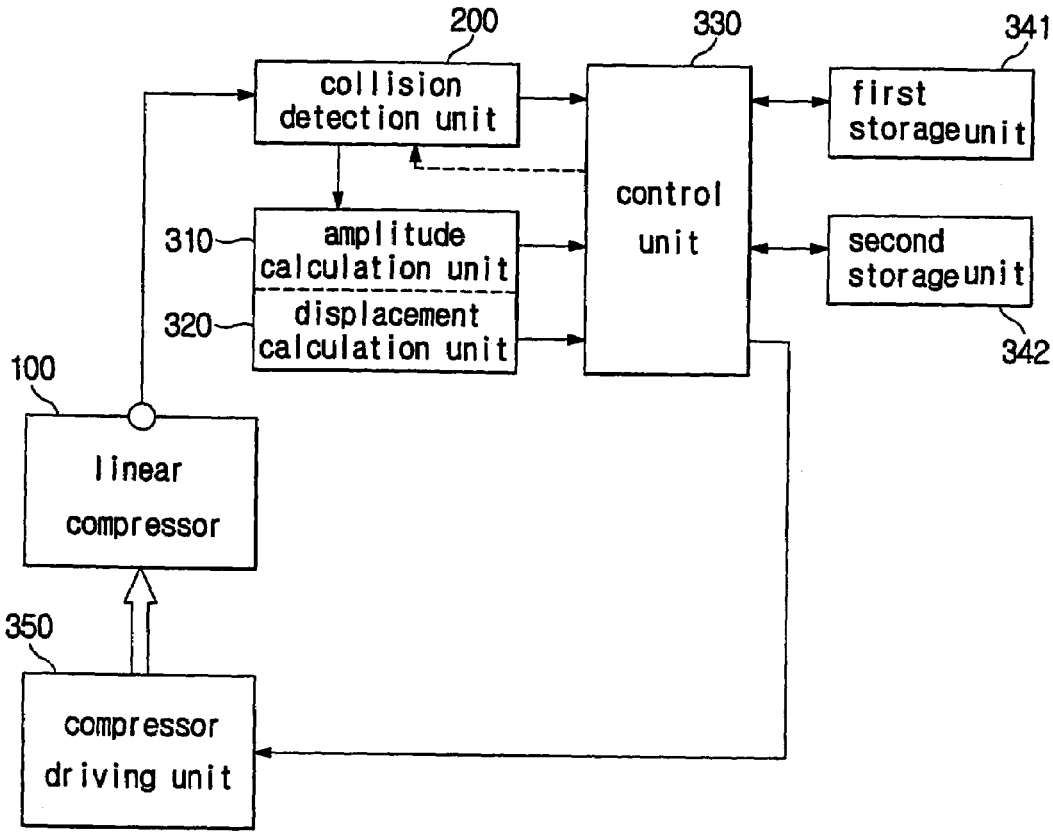
FIG. 2 is a block diagram of a linear compressor control apparatus according to a preferred embodiment of the present invention.

FIG. 2 is a block diagram of a linear compressor control apparatus according to a preferred embodiment of this invention.

Referring to FIG. 2, the linear compressor control apparatus comprises a control unit 330, a compressor driving unit 350, a collision detection unit 200, an amplitude calculation unit 310, and a displacement calculation unit 320. The control unit 330 controls the overall operation of the linear compressor control apparatus, and the compressor driving unit 350 controls the operation of a linear compressor 100 under the control of the control unit 330. The collision detection unit 200 detects the collision of a piston according to the operation of the linear compressor 100. The amplitude calculation unit 310 calculates the amplitude of the piston on the basis of an output signal from the collision detection unit 200, and the displacement calculation unit 320 calculates the displacement of the piston. Further, the linear compressor control apparatus comprises a first storage unit 341 for storing preset maximum amplitude data, and a second storage unit 342 for storing reset maximum amplitude data.

Figure 3:
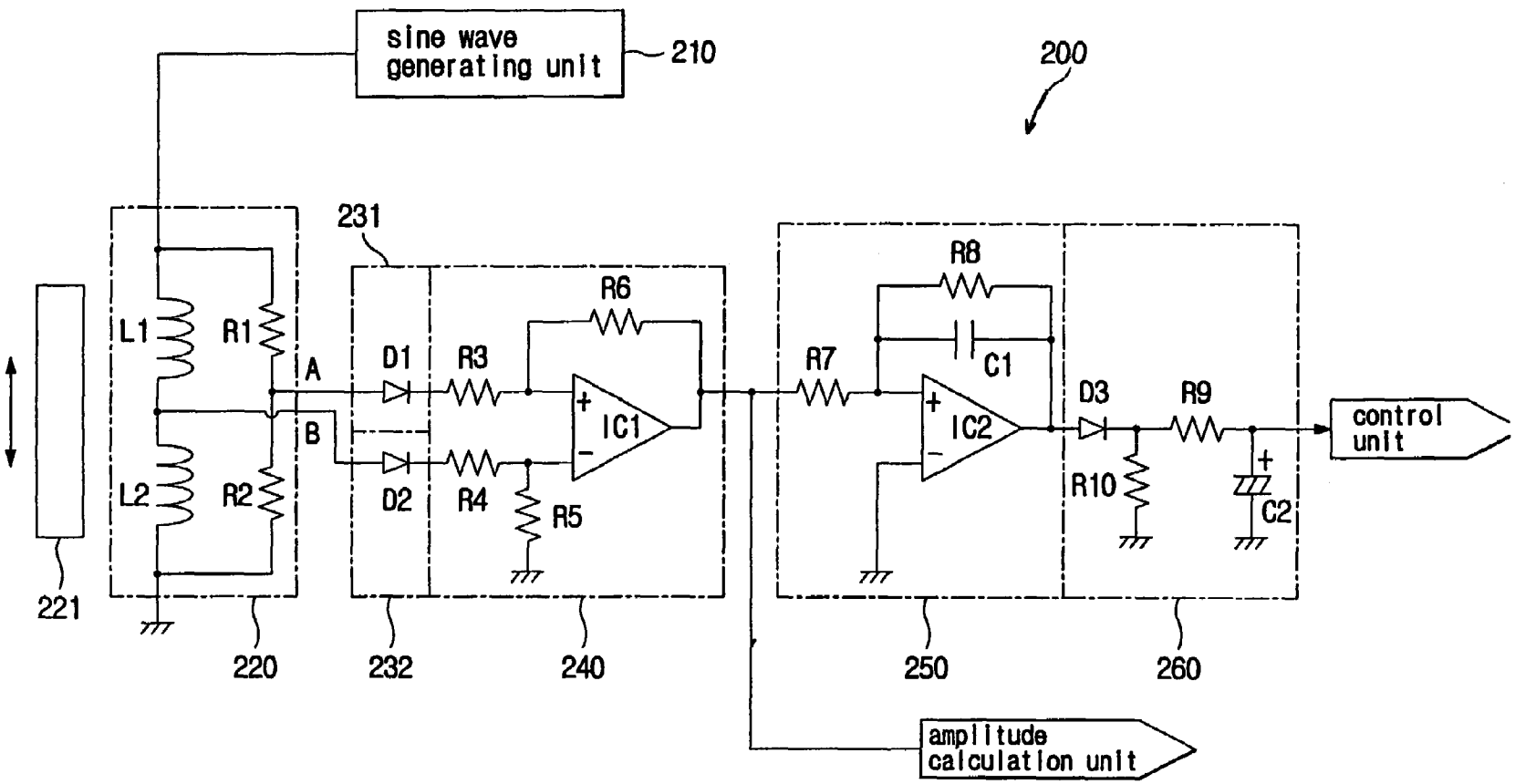
FIG. 3 is a detailed circuit diagram of a collision detection unit included in the apparatus of this invention.

FIG. 3 is a detailed circuit diagram of the collision detection unit 200 of this invention.

Referring to FIG. 3, the collision detection unit 200 includes a bridge unit 220, a core 221, a sine wave generating unit 210, first and second half-wave rectifying units 231 and 232, a differential amplifying unit 240, a low pass filter 250, and a peak detection unit 260. The bridge unit 220 has first and second coils L1 and L2 serially connected to the ground, and resistors R1 and R2 connected in parallel with the coils L1 and L2 and serially connected to each other. The core 221 of a magnetic substance linearly reciprocates while penetrating the wound coils L1 and L2 according to the movement of the piston of the linear compressor 100. The sine wave generating unit 210 generates a sine wave of several KHz and provides the sine wave to the first and second coils L1 and L2. The first and second half-wave rectifying units 231 and 232, each comprised of a diode, half-wave rectify an output signal A from the junction of the resistors R1 and R2, and an output signal B from the junction of the first and second coils L1 and L2, respectively. The differential amplifier 240 differentially amplifies output signals from the first and second half-wave rectifying units 231 and 232. The low pass filter 250 is used for low-pass filtering an output signal from the differential amplifying unit 240. The peak detection unit 260 detects the peak of an output signal from the low pass filter 250, and outputs the detected result to the control unit 330.

The differential amplifying unit 240 has an operational amplifier IC1 in which a resistor R3 and a resistor R4 are serially connected to the non-inverting and inverting input terminals thereof, respectively. Further, a resistor R5 is connected between the inverting input terminal of the amplifier IC1 and the ground, and a resistor R6 is connected between the non-inverting input terminal and the output terminal of the amplifier IC1.

The low pass filter 250 has an operation amplifier IC2 whose non-inverting input terminal is connected to an output terminal of the differential amplifying unit 240 through the resistor R7, and the inverting input terminal is connected to the ground. Further, a resistor R8 and a capacitor C1 are connected in parallel with each other between the non-inverting input terminal and the output terminal of the operational amplifier IC2.

The peak detection unit 260 detects a unidirectional movement of the piston so as to minimize the circuit size, and is provided with a diode D3, a resistor R9, a capacitor C2, and a resistor R10. The diode D3 is connected to the output terminal of the operational amplifier IC2 of the low pass filter 250 to half-wave rectify the output signal from the operational amplifier IC2. The resistor R9 is serially connected between an output terminal of the diode D3 and the control unit 330. The capacitor C2 is connected between the output terminal of the peak detection unit 260 and the ground so as to smooth the output signal from the peak detection unit 260. The resistor R10 is connected between the output terminal of the diode D3 and the ground.

Hereinafter, the control method of this invention is described in detail.

Figure 4:
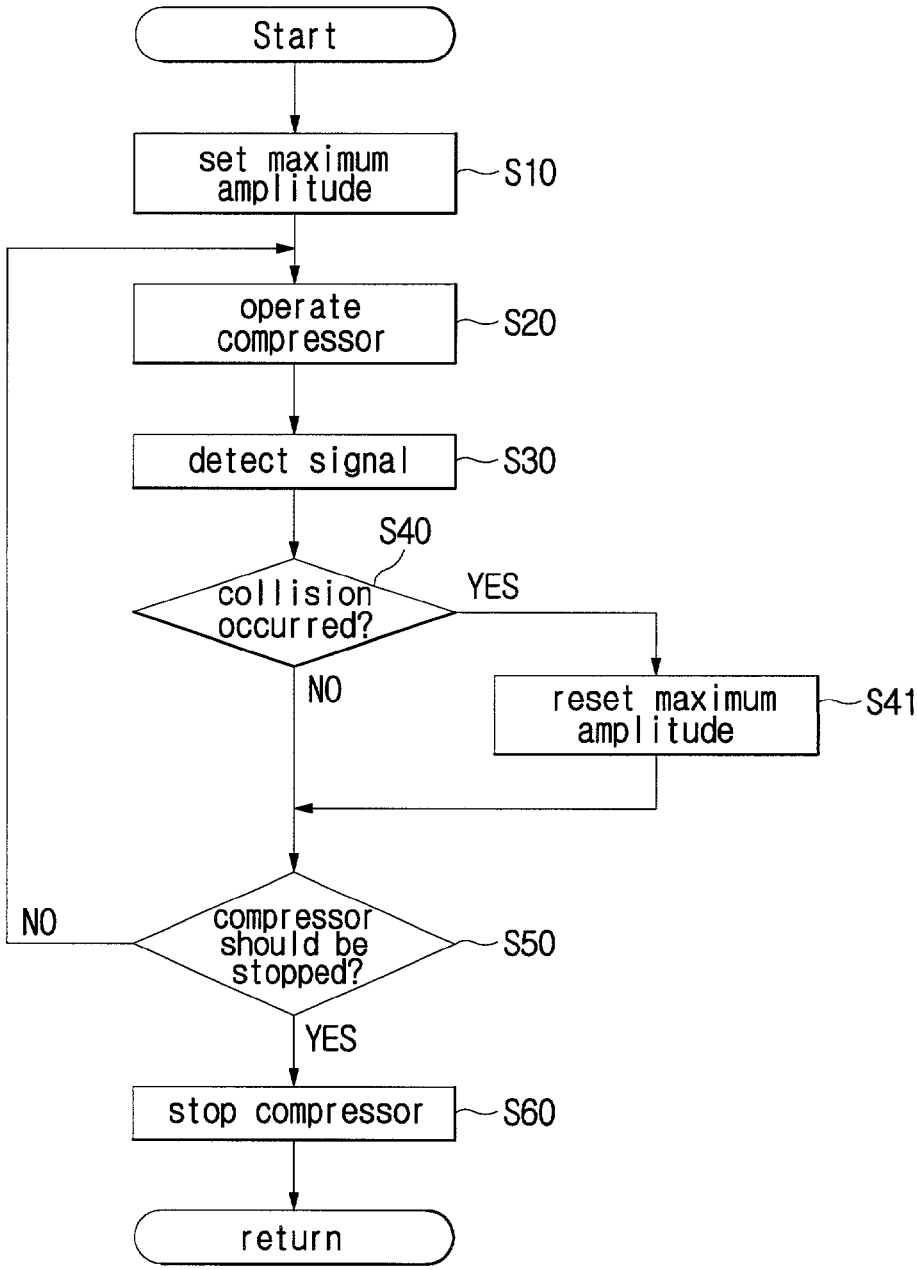
FIG. 4 is a flowchart of a linear compressor control method of this invention.

FIG. 4 is a flowchart of a linear compressor controlling method of this invention.

Referring to FIG. 4, the control unit 330 loads the preset maximum amplitude data (i.e., a first reference value) stored in the first storage unit 341, and presets a maximum amplitude of the piston of the linear compressor 100 at S10. The preset maximum amplitude data (e.g., the first reference value) is a maximum value to allow the piston of the linear compressor 100 to reciprocate without any collision, is preset when the linear compressor 100 is manufactured, and is stored in the first storage unit 341.

After presetting the maximum amplitude of the piston, the control unit 330 controls the compressor driving unit 350 to operate the linear compressor 100 using a typical operating method at S20. When the linear compressor 100 operates, the control unit 330 detects a signal through the collision detection unit 200 at S30.

The operation of the collision detection unit 200 is described as follows.

The sine wave of several KHz from the sine wave generating unit 210 is provided to the resistors R1 and R2, and the first and second coils L1 and L2 of the bridge unit 220.

When the core 221 made of a magnetic substance linearly reciprocates according to the operation of the piston (not shown) of the linear compressor 100, a magnetic field is changed as much as the position of the core 221 is changed. Accordingly, voltages proportional to the change in position of the core 221 are induced in the first and second coils L1 and L2.

The voltages induced in the first and second coils L1 and L2 are full-wave rectified by a diode D1 of the first half-wave rectifying unit 231 and a diode D2 of the second half-wave rectifying unit 232, respectively, and the rectified voltages are transmitted to the differential amplifying unit 240.

The output signal from the diode D1 is applied to the non-inverting terminal of the operational amplifier IC1 through the resistor R3, while the output signal from the diode D2 is applied to the inverting terminal of the operational amplifier IC1 through the resistor R4. Thereby, the operational amplifier IC1 differentially amplifies the input signals applied to the non-inverting and inverting input terminals thereof.

The output signal from the differential amplifying unit 240 is applied to both the low pass filter 250 and the amplitude calculation unit 310. The low pass filter 250 removes high frequency noise component generated by the sine wave generating unit 210 from the output signal of the differential amplifying unit 240, and outputs the noise-removed signal to the peak detection unit 260. The peak detection unit 260 detects the peak of the input signal applied thereto and outputs the detected result to the control unit 330.

Further, the amplitude calculation unit 310 calculates the amplitude of the piston and outputs the calculated amplitude to the control unit 330. The displacement calculation unit 320 calculates the displacement of the piston on the basis of the amplitude data calculated by the amplitude calculation unit 310, and outputs the calculated displacement to the control unit 330.

Accordingly, the control unit 330 can detect both whether the collision of the piston with a valve occurs and the amplitude and displacement of the piston, on the basis of the output signals from the peak detection unit 260, the amplitude calculation unit 310 and the displacement calculation unit 320.

As described above, after signal detection at S30, the control unit 330 determines whether the collision of the piston with a valve has occurred at in accordance with the amplitude of the signal detected by the collision detection unit 200 at S40. At S40, if it is determined that the collision has occurred, the control unit 330 resets the preset maximum amplitude of the piston at S41. In this case, the preset maximum amplitude of the piston is set by subtracting a preset amplitude value from an amplitude value measured when the collision occurs. The control unit 330 stores the reset maximum amplitude data (i.e., a second reference value) in the second storage unit 342.

After resetting the preset maximum amplitude of the piston at S41, the control unit 330 determines whether the linear compressor 100 should be stopped in response to an external signal at S50. If it is determined that the linear compressor 100 should not be stopped in response to the external signal at S50, the control unit 330 controls the operation of the linear compressor 100 through the compress driving unit 350, depending on the set maximum amplitude data (i.e., second reference value) at S20. That is, if it is determined that the collision has occurred at S40 after presetting a maximum amplitude of the piston of the linear compressor 100 at S10 based on the preset maximum amplitude data (i.e., the first reference value) and if it is determined that the linear compressor 100 should not be stopped in response to the external signal at S50, then the control unit 330 controls the operation of the linear compressor 100 through the compressor driving unit 350 based on the set maximum amplitude data (i.e., the second reference value) at S20.

On the other hand, if it is determined that the linear compressor 100 should be stopped in response to the external signal, the control unit 330 stops the operation of the linear compressor 100 through the compressor driving unit 350.

Figure 5:
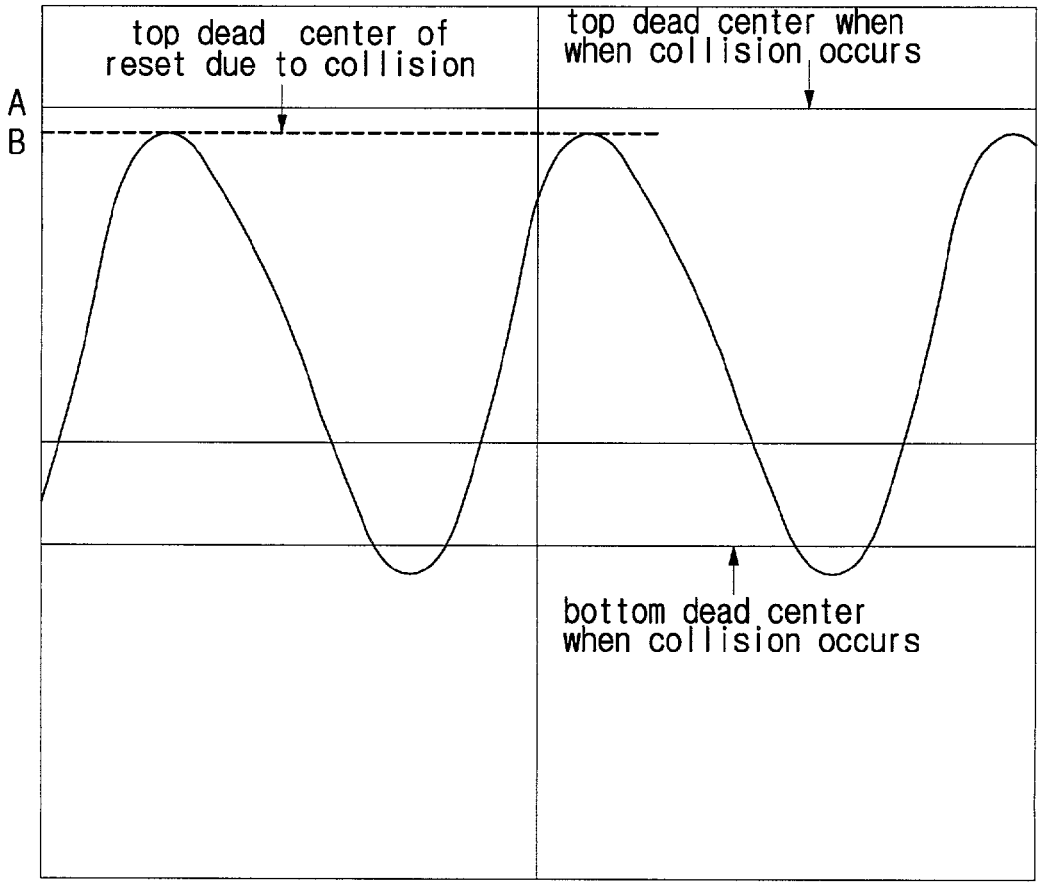
FIG. 5 is a graphic view showing the variation of dynamic characteristics according to the collision of the piston of this invention.

FIG. 5 is a graphic view showing the variation of the dynamic characteristics due to the collision of the piston in accordance with this invention. Referring to FIG. 5, A is the top dead center of the piston when the collision occurs, and B is the top dead center of the re-controlled piston after the collision occurs. FIG. 5 shows that the collision can be prevented by resetting the top dead center of the piston when the collision of the piston occurs during an operation of the linear compressor 100.

As described above, the present invention provides an apparatus and method for controlling a linear compressor, which minimizes collision of a piston of the linear compressor with a valve by minimizing the top clearance of the linear compressor, thus enabling the linear compressor to maintain a high efficient operation. Further, the present invention is advantageous in that it determines only a unidirectional moving distance, thereby minimizing the entire circuit size.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling a linear compressor, comprising:

a collision detection unit detecting a collision of a piston with a valve due to operations of the linear compressor;

a control unit determining whether the collision of the piston occurs based on an output signal from the collision detection unit; and a compressor driving unit controlling a maximum amplitude of the piston of the linear compressor under a control of the control unit, wherein the collision detection unit includes:

a bridge unit having first and second coils serially connected to a ground, and first and second resistors connected in parallel with the first and second coils and serially connected to each other;

a core linearly reciprocating by penetrating the first and second coils according to a movement of the piston of the linear compressor and made of a magnetic substance;

a sine wave generating unit providing a sine wave to the first resistor and the first coil;

first and second half-wave rectifying units, each comprising a diode half-wave rectifying an output signal from a junction of the first and second resistors, and an output signal from the junction of the first and second coils, respectively;

a differential amplifying unit differentially amplifying output signals from the first and second half-wave rectifying units;

a low pass filter removing a high frequency component of an output signal from the differential amplifying unit; and a peak detection unit detecting a peak of an output signal from the low pass filter, and outputting a detected result to the control unit.

2. The apparatus according to claim 1, wherein the peak detection unit includes:

a diode half-wave rectifying the output signal from the low pass filter;

a third resistor serially connected to an output terminal of the diode;

a capacitor connected between an output side of the third resistor and ground to perform a smoothing operation; and a fourth resistor connected between the output terminal of the diode and the ground.

3. An apparatus for controlling a linear compressor with a piston and a valve, comprising:

a detection unit detecting a collision of the piston with the valve during operation of the linear compressor according to at least a peak amplitude of the piston;

a control unit determining whether the collision of the piston occurs based on an output signal from the detection unit; and a compressor driving unit controlling a maximum amplitude of the piston according to output signals from the control, wherein the detection unit comprises a bridge circuit having first and second coils serially connected at respective first terminals of the first and second coils, and first and second resistors connected in parallel with the first and second coils and serially connected to each other at respective first terminals of the first and second resistors, a core linearly reciprocating by penetrating the first and second coils, a position of the core corresponding to a position of the piston of the linear compressor and magnetically coupling with the first and second coils, a sine wave generating unit energizing the bridge circuit at second terminals of the first and second coils, respectively, first and second rectifying units connected to the respective first terminals of the first and second coils and the respective first terminals of the first and second resistors, respectively to rectify output signals thereof, a differential amplifying unit differentially amplifying output signals from the first and second rectifying units, a low pass filter removing a high frequency component of an output signal from the differential amplifying unit, and a peak detection unit detecting a peak of an output signal from the low pass filter, and outputting a detected result to the control unit.

4. An apparatus for controlling a linear compressor with a piston and a valve, comprising:

a detection unit detecting a collision of the piston with the valve during operation of the linear compressor according to at least a peak amplitude of the piston;

a control unit determining whether the collision of the piston occurs based on an output signal from the detection unit; and a compressor driving unit controlling a maximum amplitude of the piston according to output signals from the control, wherein the detection unit comprises a position detection circuit detecting a position of a core by a differential signal provided by first and second coils when the core is linearly reciprocating by passing back and forth relative to the first and second coils and the first and second coils are excited by an external source, a low pass filter removing a high frequency component of the differential signal, and a peak detection unit detecting a peak of the differential signal output from the low pass filter, and outputting a detected result to the control unit, wherein the peak detection unit comprises:

a diode rectifying the output signal from the low pass filter, a resistor serially connected between an output terminal of the diode and an output of the peak detection unit, a capacitor connected between an output side of the resistor and a first voltage level to smooth the output of the peak detection unit, and a second resistor connected between the output terminal of the diode and the first voltage level, and the position detection circuit produces the differential signal proportional to a change in the position of the core by magnetic coupling between the core and each of the first and second coils.

* * * * *